US006543196B1

(12) United States Patent
Gonzales

(10) Patent No.: US 6,543,196 B1
(45) Date of Patent: Apr. 8, 2003

(54) FLOORING DEVICE

(76) Inventor: Manual A. Gonzales, 6061 E. 76th Ave., Commerce City, CO (US) 80022

( * ) Notice: Subject to any disclaimer, the term of this patent is extended or adjusted under 35 U.S.C. 154(b) by 0 days.

(21) Appl. No.: 09/931,814

(22) Filed: Aug. 17, 2001

(51) Int. Cl.[7] ..... E04F 13/08; E04B 9/00

(52) U.S. Cl. ..... 52/386; 52/387; 52/392; 52/384; 52/480

(58) Field of Search ..... 52/386, 387, 392, 52/384, 747.11, 749.11, 220.3, 220.2, 220.5, 177, 480, 581, 591.1; 15/215, 216, 238, 239

(56) References Cited

U.S. PATENT DOCUMENTS

| | | | | | |
|---|---|---|---|---|---|
| 1,836,964 | A | * | 12/1931 | Grigsby | 404/37 |
| 2,049,428 | A | * | 8/1936 | Denk | 156/297 |
| 2,049,429 | A | * | 8/1936 | Denk | 52/384 |
| 2,082,241 | A | * | 6/1937 | Bennett | 52/385 |
| 3,862,874 | A | * | 1/1975 | Hopper et al. | 428/47 |
| 4,047,825 | A | * | 9/1977 | Lundahl | 404/37 |
| D274,948 | S | | 7/1984 | Swanson et al. | |
| 4,744,194 | A | | 5/1988 | Yasuyoshi | |
| 4,761,926 | A | | 8/1988 | Rea et al. | |
| 4,862,668 | A | * | 9/1989 | DeGooyer | 52/232 |
| 5,238,721 | A | * | 8/1993 | Nakazawa | 156/299 |
| 5,418,036 | A | * | 5/1995 | Tokikawa et al. | 404/134 |
| 5,447,004 | A | | 9/1995 | Vrnak | |
| 5,806,270 | A | | 9/1998 | Solano et al. | |
| 6,041,567 | A | * | 3/2000 | Passeno | 249/96 |
| 6,164,037 | A | * | 12/2000 | Passeno | 249/96 |

* cited by examiner

*Primary Examiner*—Carl D. Friedman
*Assistant Examiner*—Kevin McDermott

(57) ABSTRACT

A flooring device for aligning and laying tiles. The flooring device includes a panel having an upper surface and a lower surface. The panel is flexible. The upper surface has a plurality of recesses therein bounded by ridges. A plurality of tiles each has a shape substantially identical to the recesses. Each of the tiles is positionable in one of the recesses. Each of the tiles has an upper edge, a bottom edge and a peripheral edge extending between the upper and bottom edges.

3 Claims, 4 Drawing Sheets

FLOORING DEVICE

BACKGROUND OF THE INVENTION

1. Field of the Invention

The present invention relates to tile flooring devices and more particularly pertains to a new flooring device for aligning and laying tiles.

2. Description of the Prior Art

The use of tile flooring devices is known in the prior art. More specifically, tile flooring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,744,194; 5,447,004; 1,836,964; 4,761,926; 5,806,270; and U.S. Des. Patent No. 274,948.

While these devices fulfill their respective, particular objectives and requirements, the aforementioned patents do not disclose a new flooring device. The inventive device includes a panel having an upper surface and a lower surface. The panel is flexible. The upper surface has a plurality of recesses therein bounded by ridges. A plurality of tiles each has a shape substantially identical to the recesses. Each of the tiles is positionable in one of the recesses. Each of the tiles has an upper edge, a bottom edge and a peripheral edge extending between the upper and bottom edges.

In these respects, the flooring device according to the present invention substantially departs from the conventional concepts and designs of the prior art, and in so doing provides an apparatus primarily developed for the purpose of aligning and laying tiles.

SUMMARY OF THE INVENTION

In view of the foregoing disadvantages inherent in the known types of tile flooring devices now present in the prior art, the present invention provides a new flooring device construction wherein the same can be utilized for aligning and laying tiles.

The general purpose of the present invention, which will be described subsequently in greater detail, is to provide a new flooring device apparatus and method which has many of the advantages of the tile flooring devices mentioned heretofore and many novel features that result in a new flooring device which is not anticipated, rendered obvious, suggested, or even implied by any of the prior art tile flooring devices, either alone or in any combination thereof.

To attain this, the present invention generally comprises a panel having an upper surface and a lower surface. The panel is flexible. The upper surface has a plurality of recesses therein bounded by ridges. A plurality of tiles each has a shape substantially identical to the recesses. Each of the tiles is positionable in one of the recesses. Each of the tiles has an upper edge, a bottom edge and a peripheral edge extending between the upper and bottom edges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flooring device apparatus and method which has many of the advantages of the tile flooring devices mentioned heretofore and many novel features that result in a new flooring device which is not anticipated, rendered obvious, suggested, or even implied by any of the prior art tile flooring devices, either alone or in any combination thereof.

It is another object of the present invention to provide a new flooring device which may be easily and efficiently manufactured and marketed.

It is a further object of the present invention to provide a new flooring device which is of a durable and reliable construction.

An even further object of the present invention is to provide a new flooring device which is susceptible of a low cost of manufacture with regard to both materials and labor, and which accordingly is then susceptible of low prices of sale to the consuming public, thereby making such flooring device economically available to the buying public.

Still yet another object of the present invention is to provide a new flooring device which provides in the apparatuses and methods of the prior art some of the advantages thereof, while simultaneously overcoming some of the disadvantages normally associated therewith.

Still another object of the present invention is to provide a new flooring device for aligning and laying tiles.

Yet another object of the present invention is to provide a new flooring device which includes a panel having an upper surface and a lower surface. The panel is flexible. The upper surface has a plurality of recesses therein bounded by ridges. A plurality of tiles each has a shape substantially identical to the recesses. Each of the tiles is positionable in one of the recesses. Each of the tiles has an upper edge, a bottom edge and a peripheral edge extending between the upper and bottom edges.

Still yet another object of the present invention is to provide a new flooring device that provides a panel which may be laid on a floor and tiles positioned in recesses in the panel to ensure that the tiles aligned properly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
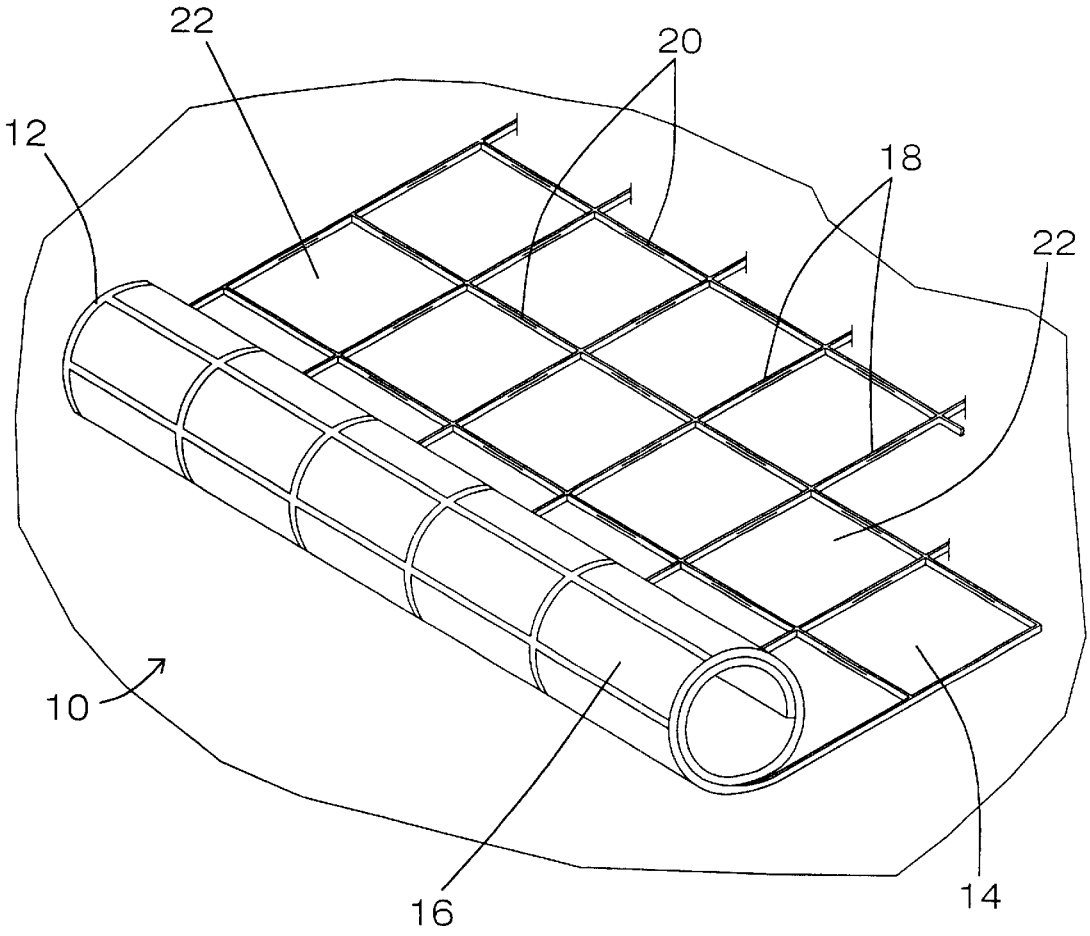
FIG. 1 is a schematic perspective view of a new flooring device according to the present invention.
Figure 2:
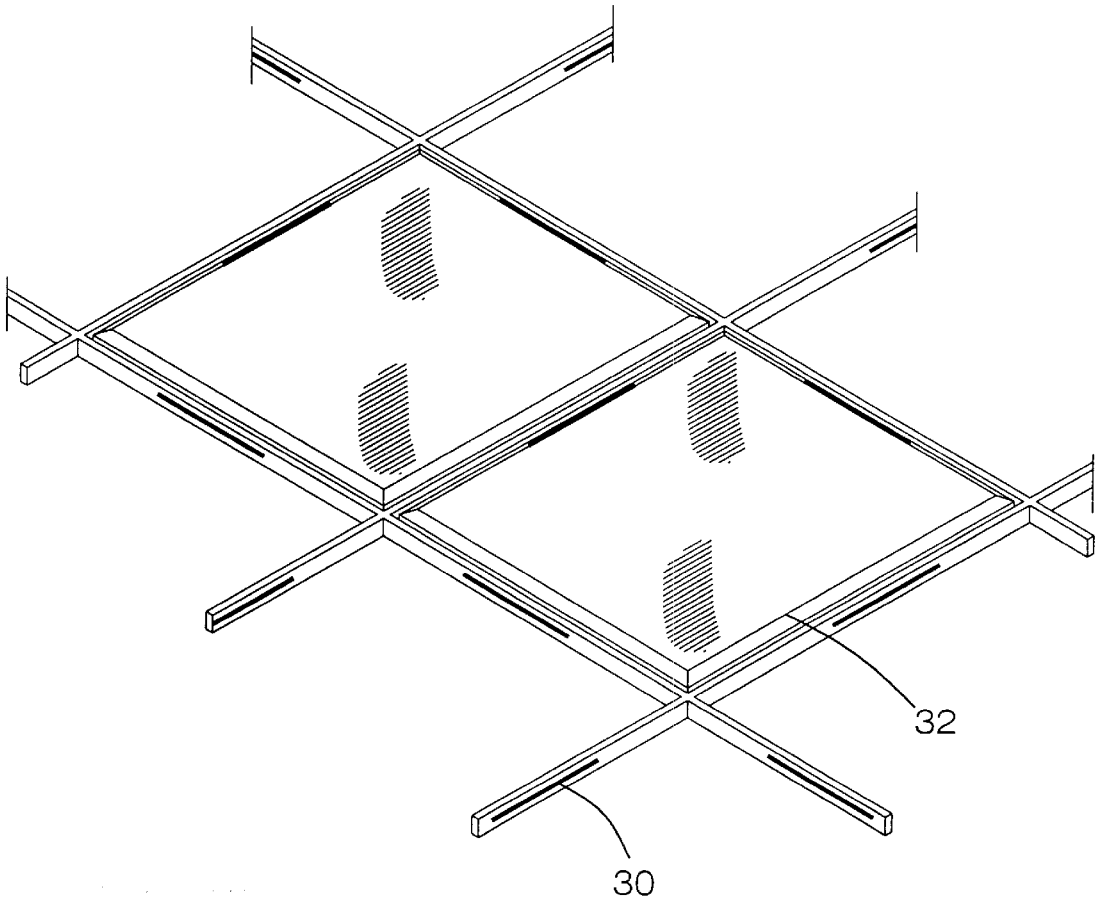
FIG. 2 is a schematic perspective view of the present invention.
Figure 3:
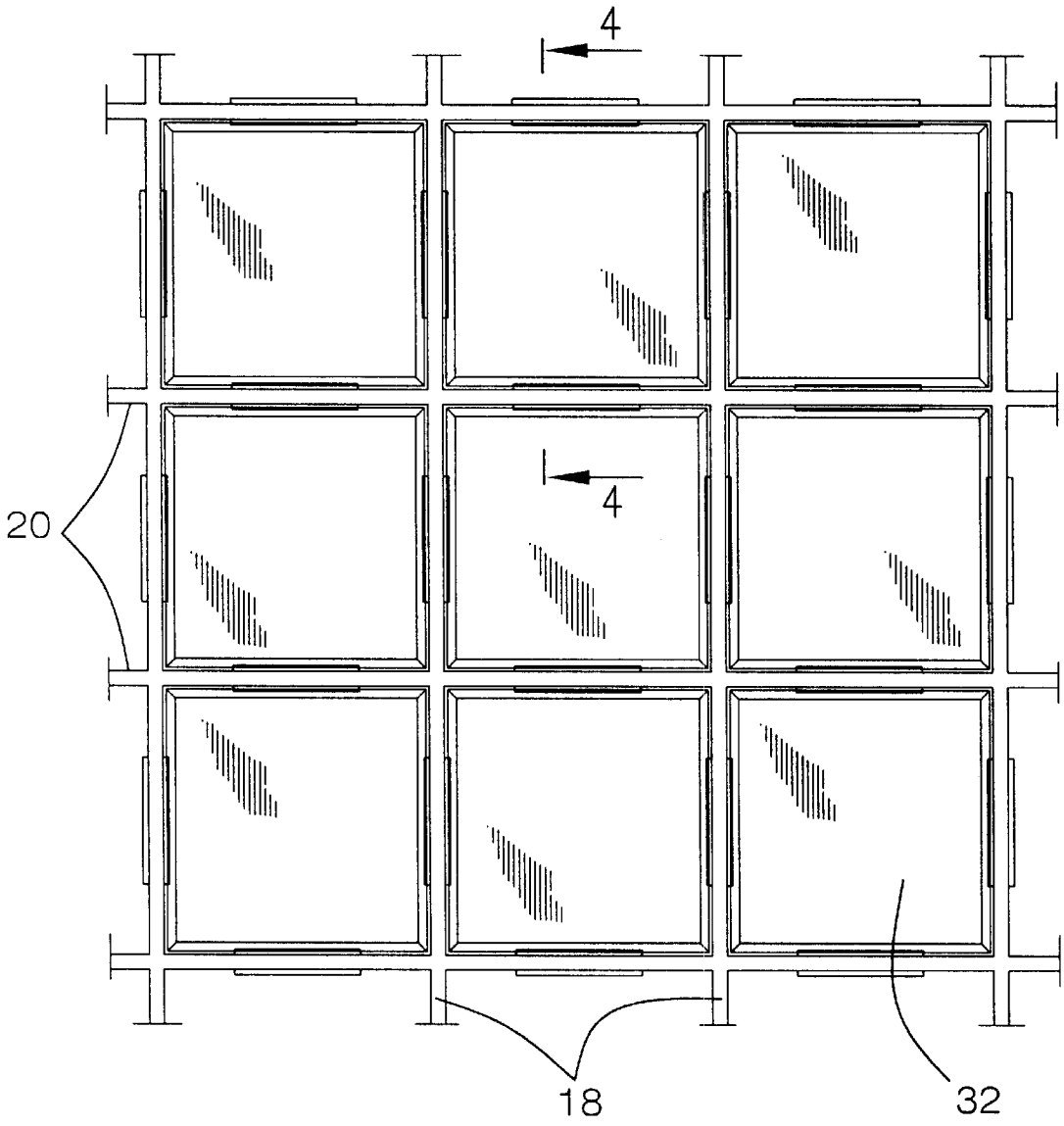
FIG. 3 is a schematic top view of the present invention.
Figure 4:
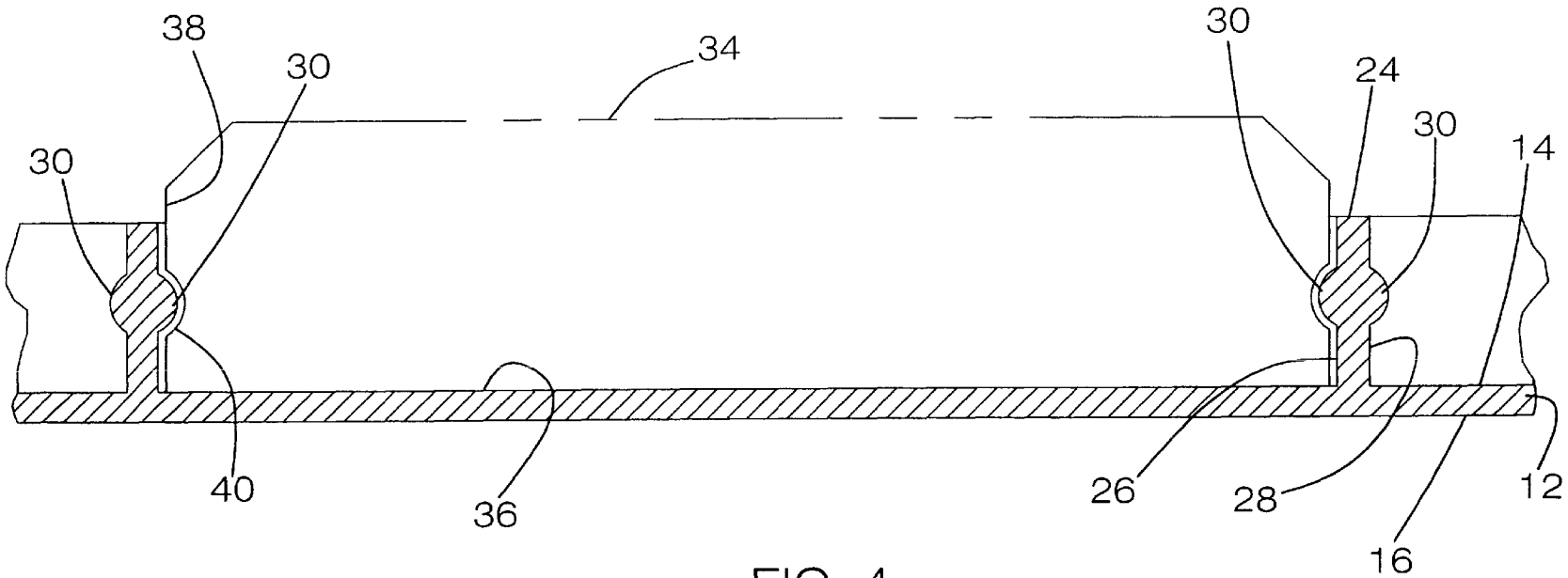
FIG. 4 is a schematic cross-sectional view of the present invention.

With reference now to the drawings, and in particular to FIGS. 1 through 4 thereof, a new flooring device embodying the principles and concepts of the present invention and generally designated by the reference numeral 10 will be described.

As best illustrated in FIGS. 1 through 4, the flooring device 10 generally includes a panel 12 having an upper surface 14 and a lower surface 16. The panel 12 is flexible. A grid is attached to the upper surface 14. The grid preferably includes a plurality of first parallel ridges 18 crisscrossing a plurality of second parallel ridges 20. The first ridges 18 are orientated generally perpendicular to the second ridges 20. Recesses 22 are defined between the ridges 18, 20. Each of the ridges 18, 20 has an upper edge 24, a first side 26 and a second side 28. Each of the first 26 and second 28 sides has a raised strip 30 thereon positioned between the upper edge 24 and the panel 12. The recesses may also have other shapes as needed.

Each of a plurality of tiles 32 has a shape substantially identical to the recesses 22. Each of the tiles 32 has an upper side 34, a bottom side 36 and a peripheral edge 38 extending between the upper 34 and bottom 36 sides. The peripheral edges 38 have elongated channels 40 therein. Each of the channels 40 is positioned for receiving one of the strips 30 when the tiles are positioned in the recesses 22 such that the tiles 32 are frictionally held in the recesses 22 by the strips 30.

In use, the device 10 holds tiles 32 in a manner which makes it easy to ensure that the tiles are aligned properly. The raised strips 30 and channels 40 allow the tiles to be snapped into the recesses 22. After the tiles 32 are positioned in the recesses 22, grout or other covering material may be positioned over the upper edge of the ridges. The lower surface 16 of the panel 12 may be adhered to a floor surface using an adhesive.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tile setting device comprising:

a panel having an upper surface and a lower surface, said panel being flexible, said upper surface having a plurality of recesses therein bounded by ridges;

plurality of tiles each having a shape substantially identical to said recesses, each of said tiles being positionable in one of said recesses, each of said tiles having an upper side, a bottom side and a peripheral edge extending between said upper and bottom sides; and wherein each of said ridges having an upper edge, a first side and a second side, each of said first and second sides having a raised strip thereon positioned between said upper edge and said panel, said peripheral edges of each of said tiles having elongated channels therein, each of said channels being positioned for receiving one of said strips when said tiles are positioned in said recesses such that said tiles are frictionally held in said recesses by said strips.

2. The tile setting device as in claim 1, wherein said recesses define a grid comprising a plurality of first parallel ridges crisscrossing a plurality of second parallel ridges, said first ridges being orientated generally perpendicular to said second ridges.

3. A tile setting device comprising:

a panel having an upper surface and a lower surface, said panel being flexible;

a grid being attached to said upper surface, said grid including a plurality of first parallel ridges crisscrossing a plurality of second parallel ridges, said first ridges being orientated generally perpendicular to said second ridges, recesses being defined between said ridges, each of said ridges having an upper edge, a first side and a second side, each of said first and second sides having a raised strip thereon positioned between said upper edge and said panel; and a plurality of tiles, each of said tiles having a shape substantially identical to said recesses, each of said tiles having an upper side, a bottom side and a peripheral edge extending between said upper and bottom sides, said peripheral edges having elongated channels therein, each of said channels being positioned for receiving one of said strips when said tiles are positioned in said recesses such that said tiles are frictionally held in said recesses by said strips.

* * * * *